US005330002A

United States Patent [19]

Saunders

[11] Patent Number: 5,330,002

[45] Date of Patent: Jul. 19, 1994

[54] HANGER ASSEMBLY

[75] Inventor: Brian Saunders, Bristol, England

[73] Assignee: Cooper Industries, Inc., Houston, Tex.

[21] Appl. No.: 7,419

[22] Filed: Jan. 22, 1993

[30] Foreign Application Priority Data

Jan. 22, 1992 [EP] European Pat. Off. ..... 92300551.6

[51] Int. Cl.[5] ..... E21B 33/04

[52] U.S. Cl. ..... 166/208; 166/216; 166/217

[58] Field of Search ..... 166/88, 208, 342, 380, 166/382, 216, 217

[56] References Cited

U.S. PATENT DOCUMENTS 4,615,544 10/1986 Baugh ..... 166/348 X
4,759,409 4/1987 Gullion .
4,781,387 6/1987 Baugh .
4,790,572 12/1987 Slyker .
4,903,992 4/1989 Jennings et al. .
4,942,925 7/1990 Themig ..... 166/208 X
4,949,786 8/1990 Eckert et al. ..... 166/208
4,949,787 8/1990 Branmen et al. ..... 166/208
5,025,864 6/1991 Nobileau ..... 166/208 X
5,031,695 7/1991 Cain et al. ..... 166/208 X
5,086,845 2/1992 Baugh ..... 166/208 X

FOREIGN PATENT DOCUMENTS 2217795A 12/1988 United Kingdom .
2221484A 7/1989 United Kingdom .

OTHER PUBLICATIONS

EPC Application No. EP-A 0344087, filed May 18, 1989.

*Primary Examiner*—Ramon S. Britts
*Assistant Examiner*—Frank S. Tsay
*Attorney, Agent, or Firm*—William B. Patterson; Eddie E. Scott

[57] ABSTRACT

A hanger (3) is suspended and sealed within a wellhead housing (5) by means of a landing ring which engages teeth (8) on the hanger, and a sealing device consisting of wedge rings (15 and 16) which seal respectively against the teeth (8) and the wall of the housing (5).

8 Claims, 1 Drawing Sheet

HANGER ASSEMBLY

In the formation or operation of a well in an oil or gas field, it is sometimes desirable to be able to tie a hanger for a working or production string back at a wellhead at an adjustable height. For example this may be desirable in a subsea tie-back system for a production string casing hanger when the height from the mudline to a platform is uncertain or variable.

To meet this contingency, it is known to provide complementary annular ratchet teeth on a hanger and on a surrounding spool or other housing but in order to allow appreciable variation in the height at which the hanger is to be suspended, the teeth on the hanger must extend over a significant axial length of the hanger. In addition it is usually necessary to provide a high pressure proof seal between the hanger and surrounding housing in which the hanger is suspended and provision must be made beyond the end of the toothed portion of the hanger for engagement of the hanger by an appropriate sealing device. This requires the sealing device to be spaced from the toothed portion of the housing by at least the length of the toothed portion of the hanger.

The object of the invention is to reduce the completion height which has previously been necessary to accommodate such a hanger.

In accordance with the present invention, a hanger assembly for a wellhead comprises a tubular metal hanger having a portion with a series of axially spaced, external, annular teeth, a supporting device, which is arranged to be landed in a surrounding tubular housing and which is engageable with selected ones of the hanger teeth to suspend the hanger at a selected height within the housing; and a sealing device including a wedge and a metal sealing ring surrounding the toothed portion of the hanger and deformable radially inwardly into sealing contact with at least one of the hanger teeth by relative axial movement between the sealing ring and the wedge.

With this arrangement, since both the supporting and sealing devices engage the same toothed profile of the hanger, they may be spaced closely together, thereby leading to a shorter completion height in the wellhead than would otherwise be possible.

In order to complete a seal between the hanger and housing, the sealing device may include a second deformable metal sealing ring and the action of the wedge, which may itself be formed by the second sealing ring, is also arranged to deform the second sealing ring radially outwardly into sealing contact with the surrounding housing.

Although the supporting device could, in theory, consist of a ring of circumferentially spaced dogs, it is preferably provided by a split landing ring, particularly of C-shape, having a series of axially spaced internal annular teeth complementary to the hanger teeth. The landing ring is then radially expandable so that the landing ring may ride over the hanger teeth relatively down the hanger during suspension of the hanger. There will then be a packoff which is arranged to be inserted axially between the landing ring and surrounding housing to hold the landing ring radially contracted and hence hold the teeth on the hanger and those on the landing ring in engagement with one another when the hanger is at its selected height with the landing ring landed in the housing.

Since the sealing device is energized by relative axial movement of the wedge, an axial counter-reaction must be provided so that the movement of the wedge can be converted by wedging action into radial deformation of at least the first sealing ring. This axial counter-reaction may be provided by the packoff which acts as an abutment for the sealing device.

When the sealing device includes both the first and second sealing rings, the second ring forming the wedge, there may be a carrier tool for the sealing device, the tool being arranged to be forced downwards to provide the relative axial movement and hence to energize the sealing device by deforming the two sealing rings; the packoff being a ring captively, but relatively axially movably, supported from the carrier tool by a sleeve passing down between wedge surfaces of the two sealing rings, whereby the carrier tool, sealing device and packoff ring form a unitary assembly. With this arrangement, the packoff ring and sealing assembly can be inserted into the annulus between the hanger and casing as one preassembly, both to contract and lock the landing ring to the hanger, and thereafter to energize the sealing device.

An example of a hanger assembly constructed in accordance with the present invention is illustrated in the accompanying drawing, in which.

Figure 1:
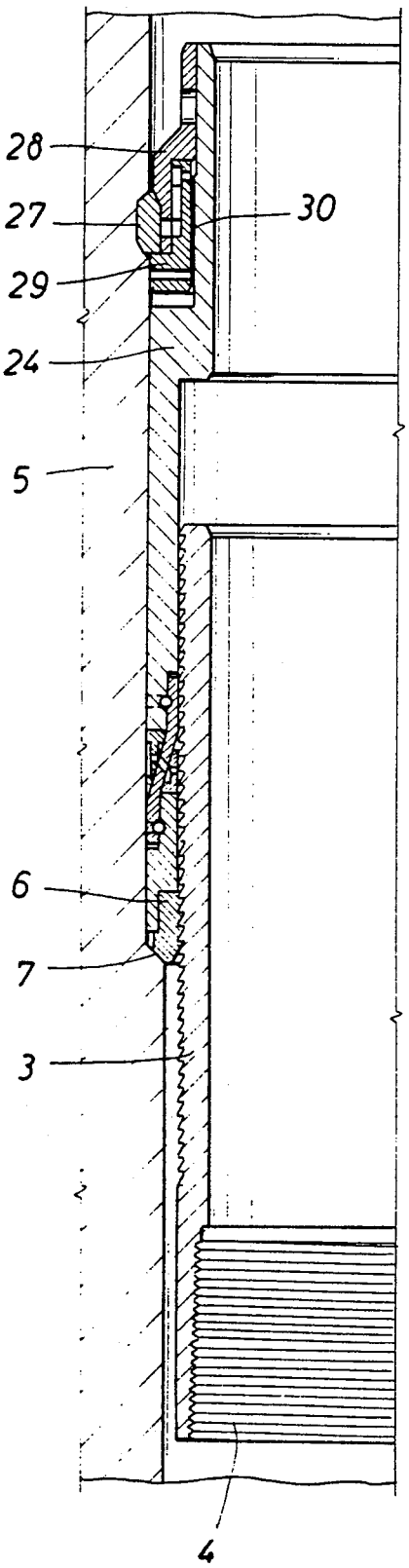
FIG. 1 is a part axial section of the assembly and associated parts.

As shown, a tubular hanger 3 has at its lower end a conventional screw threaded coupling 4 for connection to the upper end of a production casing string. The hanger is shown suspended within a housing 5, situated, for example at a tie-back wellhead on a platform and fixed, directly or indirectly, to a riser extending down to a mudline suspension system of a subsea oil well. The hanger 3 is carried in the housing 5 by means of a C-shaped radially expandable and contractible locking ring 6 which seats in a landing bowl 7 formed on the inner surface of the housing 5. The outer surface of the hanger 3 is provided with an axially spaced array of annular teeth 8, each with a downwardly inclined upper flank, a substantially horizontal lower flank, and a blunt tip conforming to a substantially cylindrical envelope. The landing ring 6 has a similar, but axially inverted, set of four axially spaced annular teeth 9, which complement the teeth 8.

Above the landing ring 6 is a packoff ring 10 having a depending annular skirt 11 with a chamfered end 12, which can ride down over a chamfer 13 on the landing ring 6, to a position surrounding the landing ring, whereby the landing ring is held radially contracted and in secure engagement with the hanger. In this position a shoulder 14 on the packoff ring seats rigidly on the upper surface of the landing ring 6.

Above the packoff ring is a so called "Canh" sealing device consisting of two wedge sealing rings 15 and 16 which are located one on each side of a frustoconical portion 17 of a sleeve 18 having cylindrical end portions 19. The ring 15 has an outer wedge surface 15A extending parallel to a sleeve surface 17A, and the ring 16 has an inner wedge surface 16A extending parallel to a sleeve surface 17B. The lower end portion 19 is captively but axially movably coupled with the packoff ring 10 by means of a plurality of balls 20, which are located partly within an annular groove 21 of semi-circular cross-section in the sleeve 18, and partly within an annular groove 22 in the packoff ring 10, the groove 22 having a cross-section which is elongate in the axial direction. The upper end portion 19 of the sleeve 18 is similarly captively, but axially movably, coupled by balls 23 to the lower end of a carrier tool 24. As shown, the wedge sealing ring 15 seats on the top of the packoff ring 10, and the lower end of the tool 24 abuts the upper end of the sealing ring 16. When the sealing device is energized, two cylindrical sealing surfaces 25 on the ring 15 seal against a respective pair of the teeth 8 on the hanger, while four annular sealing rings 26 on the ring 16 are in sealing engagement with the inner surface of the housing 5.

Figure 2:
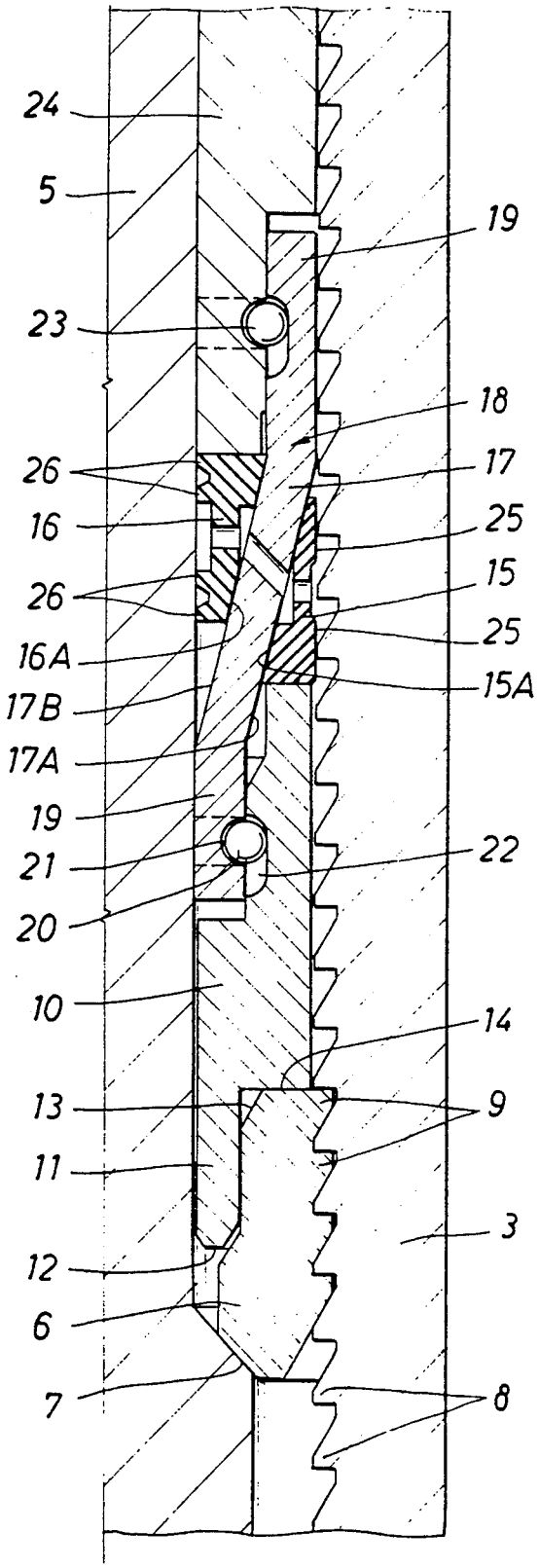
FIG. 2 is an enlargement of part of FIG. 1.

Assembly is carried out by suspending the hanger 3 and tubing string stretched, with the hanger within the housing 5, and then forcing the landing ring 6 down around the hanger 3 by means of an hydraulic setting tool. The ring 6 can ride down the hanger because of the ratchet effect of the inclined faces of the teeth 8 and 9, and this continues until the ring 6 lands in the bowl 7. At that time some of the teeth 8 may not be exactly aligned with the teeth 9, and the tension in the tubing spring is relaxed so that the hanger moves slightly down through a distance less than the pitch of the teeth 8, to the fully engaged position shown in FIGS. 1 and 2. The hanger and tubing string are then secured against downward movement within the housing 5.

After withdrawal of the setting tool, the sub assembly consisting of packoff ring 10, sealing device and carrier tool 24 are lowered down into the annulus between the hanger 3 and housing 5 until the skirt 11 rides around the landing ring 6, to hold the landing ring radially contracted and hence resist any relative movement between the landing ring and hanger in the event of upward compressive loads through the tubing spring. The tool 24 is thereafter forced downwards to energize the sealing device, against a counteraction provided by the packoff ring 10 from the landing bowl 7. The energization naturally occurs owing to the wedge shape of the rings 15 and 16, the ring 15 being deformed radially inwardly into secure metal to metal contact with respective ones of the teeth 8, and the ring 16 being deformed radially outwardly so that the ribs 26 are forced into secure metal to metal sealing engagement with the inner surface of the housing 5. The relative movement between the tool 24 and packoff ring 10, to accommodate the wedging is accommodated by the coupling balls 20 and 23 moving in the elongate slots.

The sealing device is held locked down by a mechanism comprising a split locking ring 27, which is held expanded in engagement with an annular seating in the wall of the casing by a packoff ring 28, and by an abutment ring 29, which abuts the underside of the ring 27 and is coupled to the tool 24 by a screw threaded connection 30. The mechanism may be set by a second hydraulic setting tool which provides the necessary downward face on the tool 24 and then sets the seal device lockdown mechanism to maintain the axial compression in the sealing device, before removal of the second setting tool. The operation of the second setting tool and lockdown mechanism is generally as disclosed in our EP-A-0421037.

I claim:

1. A hanger assembly for a wellhead, comprising:

a tubular housing having a landing face on an inside surface thereof;

a tubular metal hanger disposed coaxially within said housing and spaced radially inwardly therefrom to form therewith a space, said hanger having axially spaced, circumferentially extending external teeth;

a supporting device disposed in said space and seated on said landing face, said supporting device engaging at least one of said teeth for suspending said hanger in said housing;

sealing means comprising an annular metal sealing ring disposed in said space in surrounding relationship to at least one of said teeth and in sealing engagement therewith; and actuating means urging said sealing ring into said sealing engagement with said at least one tooth, comprising:

a wedge disposed in said space and oriented to apply a radial inward force to said sealing ring in response to relative axial movement between said sealing ring and said wedge, and means for producing said relative axial movement.

2. A hanger assembly according to claim 1, wherein said sealing ring constitutes a first sealing ring, said wedge being formed of metal and constituting a second sealing ring, said second sealing ring being in sealing relationship with said inside surface of said housing.

3. A hanger assembly according to claim 2, wherein said first sealing ring includes an outwardly facing first wedge surface, said second sealing ring including an inwardly facing second wedge surface, said actuating means comprising a sleeve having a frusto-conical portion interposed between, and in contact with, said first and second wedge surfaces, said means for producing said relative axial movement comprising a tool for pushing axially downwardly on said second sealing ring.

4. A hanger assembly according to claim 3 including a pack-off ring disposed in said space and seated upon said supporting device, said first sealing ring being seated upon said pack-off ring, said sleeve including upper and lower cylindrical portions disposed at upper and lower ends of said frusto-conical portion, said upper cylindrical portion disposed radially between said teeth and said tool, said pack-off ring and said inside surface of said housing, said upper and lower cylindrical portions being connected to said tool and said pack-off ring, respectively, for limited axial movement with respect thereto wherein, said tool, said sleeve, said pack-off ring, and said first and second sealing rings being movable axially together as a unit.

5. A hanger assembly according to claim 1, wherein said supporting device includes radially inwardly projecting teeth spaced axially apart for engaging said teeth of said hanger.

6. A hanger assembly for a wellhead, comprising:

a tubular housing having an inner surface;

a tubular metal hanger suspended coaxially within said housing and spaced radially inwardly therefrom such that an outer surface of said housing and an inner surface of said housing form a space therebetween;

a pack-off ring mounted in said space; and sealing means sealingly engaging said inner and outer surfaces, comprising:

a first metal seal comprising an annular ring sealingly engaging said outer surface and including a radially outwardly facing first wedge surface, a second metal seal comprising an annular ring sealingly engaging said inner surface and including a radially inwardly facing second wedge surface, a sleeve including a portion interposed between said first and second wedge surfaces, said sleeve portion having first and second sleeve surfaces extending parallel to, and in engagement with, said first and second wedge surface, respectively, one of said first and second metal seals being seated on said pack-off ring, and a tool engaging the other of said first and second metal seals and applying thereto a downward force transmitted to said second metal seal through said sleeve portion, for wedging said second metal seal between said inner surface and said first sleeve surface, and wedging said first metal sleeve between said outer surface and said second sleeve surface.

7. A hanger assembly according to claim 6, wherein said tool is connected to said sleeve by a first axially movable connection, and said sleeve being connected to said pack-off ring by a second axially movable connection so that upon upward movement of said tool, said downward force is relieved from said first and second metal seals, and wherein said pack-off ring, said sleeve, and said first and second metal sleeves are removable from said space as a unit together with said tool.

8. A hanger assembly according to claim 7, wherein said outer surface of said hanger is defined by axially spaced, circumferentially extending external teeth, and further including a supporting device seated in said space upon a landing face of said housing, said supporting device including teeth engaging said teeth of said hanger for suspending said hanger in said housing, said pack-off ring being seated on said supporting device and including means urging said supporting device radially inwardly toward said hanger.

* * * * *